United States Patent [19]

Langlois et al.

[11] 4,087,347

[45] May 2, 1978

[54] SHALE RETORTING PROCESS

[75] Inventors: Gordon E. Langlois, Lafayette; Paul W. Tamm, Oakland, both of Calif.

[73] Assignee: Chevron Research Company, San Francisco, Calif.

[21] Appl. No.: 724,800

[22] Filed: Sep. 20, 1976

[51] Int. Cl.[2] ..... C10G 1/02

[52] U.S. Cl. ..... 208/11 R; 201/12; 201/34

[58] Field of Search ..... 208/11 R, 8; 201/12, 201/34

[56] References Cited

U.S. PATENT DOCUMENTS

| | | | |
|---|---|---|---|
| 2,582,712 | 1/1952 | Howard | 208/8 |
| 2,634,198 | 4/1953 | Kalbach | 208/8 |
| 3,281,349 | 10/1966 | Evans | 208/11 R |
| 3,501,394 | 3/1970 | Lyons | 208/11 R |
| 3,655,518 | 4/1972 | Schmalfed et al. | 208/11 R |
| 3,784,462 | 1/1974 | Frick | 208/11 R |

*Primary Examiner*—Delbert E. Gantz

*Assistant Examiner*—James W. Hellwege

*Attorney, Agent, or Firm*—D. A. Newell; R. H. Davies; J. J. DeYoung

[57] ABSTRACT

Disclosed is a process for the retorting of shale and other similar hydrocarbon-containing solids in which the solids to be retorted are mixed with a solid heat transfer material to rapidly heat the hydrocarbon-containing solids to a high temperature. The shale and heat-transfer material are entrained in a high-velocity gaseous stream and conveyed upward in a vertical dilute phase lift pipe retorting vessel whereby the hydrocarbon-containing solids are rapidly heated to an elevated temperature vaporizing a minor portion of the hydrocarbons in the solid. The hydrocarbon-containing solids then pass into a disengaging zone wherein the gas and solids are separated. The partially retorted solids then pass into a gravitating bed retort and flow downward countercurrent to the flow of a stripping gas. The process is characterized by a high liquid yield and a minimum gas yield along with minimal amounts of volatile components being left in the retorted solids.

2 Claims, 2 Drawing Figures

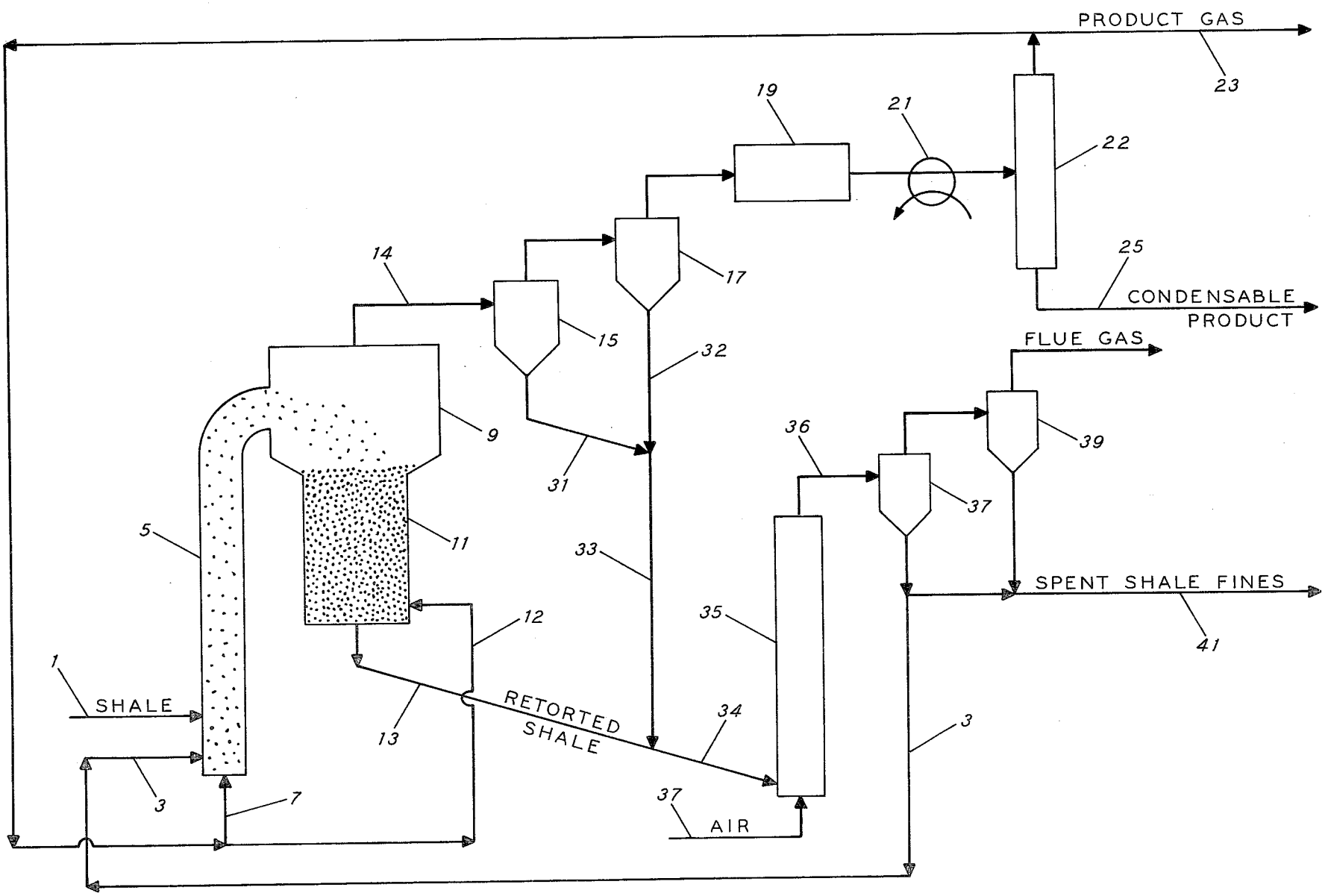
PRODUCT GAS
23
22
CONDENSABLE PRODUCT
25
21
19
17
15
14
9
11
12
13
RETORTED SHALE
7
5
SHALE
1
3
FLUE GAS
39
SPENT SHALE FINES
41
37
36
35
34
AIR
37
3
32
33
31

SHALE RETORTING PROCESS

BACKGROUND OF THE INVENTION

This invention relates to the retorting of hydrocarbon-containing solids, particularly shale.

Shale oil is not a naturally occurring product, but is formed by the pyrolysis or distillation of organic matter, commonly called kerogen, formed in certain shale-like rock. The organic material has limited solubility in ordinary solvents and therefore cannot be recovered by extraction. Upon strong heating, the organic material decomposes into a gas and liquid. Residual carbonaceous material typically remains on the retorted shale.

In its basic aspects, the retorting of shale and other similar hydrocarbon-containing solids is a simple operation. The major step involves the heating of the solid material to the proper temperature and the recovery of the vapor evolved. However, for a commercially feasible process, it is necessary to consider and properly choose one of the many possible methods of physically moving the solids through a vessel in which the retorting is to be carried out as well as the many other variances in operating parameters, all of which are interrelated. The choice of a particular method of moving the solids through the vessel must include a consideration of mechanical aspects as well as the chemistry and the processes involved. Further, it is necessary to consider the many possible sources of heat that may be used for the pyrolysis or destructive distillation.

In order to achieve a retorting process that is economically attractive and one which produces the maximum amount of high-quality shale oil, the various operating parameters must be controlled so that the overall process is economical, continuous and highly reliable. Any equipment usable in the process must permit a high throughput of material since enormous quantities of shale must be processed for a relatively small recovery of shale oil. Process equipment for shale must have a high thermal efficiency and as in the case of all mechanical devices, the retorting equipment should be as simple as possible so that a relatively proven and economically attractive mechanical device may be utilized in the operation of the retort.

In an effort to provide an economically commercial process, literally hundreds of retorting processes have been proposed, each of which offer a somewhat different choice and/or combination of the many possible operating conditions and apparatus.

One problem with many prior art processes is that the quality of shale oil obtained is relatively low. A common problem with many prior art processes is the long residence time at high temperatures which results in many secondary and undesirable side reactions such as cracking, which may increase the production of normally gaseous products and decrease the yield and quality of the condensable product. Another problem with many prior art processes is that a portion of the shale oil is combusted, which also leads to a decrease in the yield of condensable hydrocarbons. Thus, in any process designed to produce the maximum yield of high quality condensable hydrocarbons, it is preferred that the retorting take place in the absence of molecular oxygen and that the volatilized hydrocarbons are quickly removed from the retorting vessel in order to minimize deleterious side reactions such as cracking or polymerization.

The quality and yield of shale oil produced is greatly dependent upon how the retorting process is operated. For example, the raw shale can be heated rapidly or slowly and the shale can be finely divided or vary widely in size. These and many other factors greatly influence the quality and quantity of the shale oil produced and the overall thermal efficiency of the process. In essentially all processes for the retorting of shale, the shale is first crushed to reduce the size and time necessary for the retorting process. During the crushing or mining of the shale, it is difficult to obtain uniformly sized pieces and/or costly to separate the crushed shale into various sizes. Also, it is extremely expensive to crush all of the shale to a very small uniform size. It is therefore desirable to have a retorting process which can accommodate a wide-size range of solids.

Another problem with many prior art processes, particularly with countercurrent flow processes, is that after the shale oil has been vaporized, it then comes in contact with countercurrent flowing solids which are at a much cooler temperature, which leads to condensation of a portion of the shale oil and reabsorption of a portion of the vaporized shale oil into the down-flowing shale. This condensation and reabsorption leads to coking, cracking and polymerization reactions, all of which are detrimental in regard to producing the maximum yield of condensable hydrocarbons.

In one aspect of the present invention, a counter-current flowing stripping gas is utilized. Retorting processes utilizing countercurrent flow of a stripping gas are well known in the art. For example, U.S. Pat. No. 3,736,247 describes a process wherein shale is fed into the top of a vertical retort and moves downward countercurrent to the flow of an upward flowing stripping gas. However, the upward-moving stripping gas contains oxygen and a portion of the shale oil is combusted in the retort, leading to decreased yields of normally liquid hydrocarbons.

Retorting processes using sand or other solid heat-transfer materials are also known in the art as shown, for example, in U.S. Pat. No. 2,788,314.

A gas lift retorting process is described in U.S. Pat. No. 3,501,394. However, in this patent, shale fines are completely retorted by contact with a noncombustable lift gas. Relatively long contact times of 5 to 30 seconds are required to completely retort the shale which requires a very long lift tube. Furthermore, only shale fines can be used in the process and it is very expensive to crush shale down to the size of fines.

Disclosed in U.S. Pat. No. 3,925,190 is a retorting process wherein the shale is preheated in a series of risers. The temperatures are carefully controlled in the risers to avoid premature pyrolysis. Furthermore, the shale is preheated by combusting a portion of the shale with an oxygen-containing gas.

Lift-type combustors involving the combustion of a hydrocarbon-containing solid are also well known in the art as shown, for example, in U.S. Pat. No. 3,501,394.

The present invention overcomes these and other problems and provides a new retorting process that achieves high oil recovery at high retorting rates, permits accurate control of retorting temperatures, avoids combustion of products with oxygen, minimizes degradation of the condensable product, minimizes the gaseous products and simultaneously processes a wide-size range of shale at high retorting efficiency.

SUMMARY OF THE INVENTION

A continuous process for retorting hydrocarbon-containing solids which comprises:

(a) introducing a solid heat-transfer material at an elevated temperature and hydrocarbon-containing solids into a lower portion of a first vertically elongated vessel;

(b) passing a lift gas upwardly through said first vessel at a velocity sufficient to entrain and convey said solids and said heat-transfer material upwardly through said vessel whereby said solids and said heat-transfer material are intermixed and said solids are rapidly heated to an elevated temperature vaporizing a first portion of the hydrocarbons in said solids;

(c) separating a solid fraction from said lift gas, said solid fraction comprising said heat-transfer material and hydrocarbon-containing solids;

(d) introducing said solid fraction into the upper portion of a second vertically elongated vessel forming a downwardly moving bed of solids wherein additional heat is transferred from said heat-transfer material to said solids vaporizing a second portion of the hydrocarbons in said solids;

(e) withdrawing retorted solids and said heat-transfer material from a lower portion of said second vessel;

(f) passing a stripping gas upwardly through said second vessel which entrains said vaporous second portion of hydrocarbons; and (g) separating condensable hydrocarbons from said lift gas and said stripping gas.

BRIEF DESCRIPTION OF THE DRAWING

The drawing is a schematic flow diagram illustrating the flow of gas and solids through the two retorting vessels along with auxiliary processing equipment.

DETAILED DESCRIPTION OF THE INVENTION AND PREFERRED EMBODIMENTS

An object of the present invention is to provide an economic process for the retorting of shale so as to provide the maximum yield of condensable hydrocarbons combined with the minimum production of gaseous products.

A further object of the invention is to produce retorted shale containing the minimum amount of residual volatilizable hydrocarbons.

Another object of the invention is to provide a continuous retorting process which has a high thermal efficiency along with a high throughput of solids.

Another object of the present invention is to provide a retorting process which can accommodate a wide size range of solids.

The process of the present invention will generally be described with reference to the processing of shale. However, the process of the present invention can also be used to retort other hydrocarbon-containing solids as defined herein.

The term "hydrocarbon-containing solid38 as used herein is intended to include oil shale, oil sand, coal, tar sands, gilsonite, mixtures of two or more of these materials or any other hydrocarbon-containing solids with inert materials, etc.

As used in the present invention the term "oil shale" is intended to mean inorganic material which is predominantly clay, carbonates and silicates in conjunction with organic materials composed of carbon, hydrogen, sulfur, oxygen and nitrogen, called kerogen.

The term "retorted solids" is used in the present application to mean hydrocarbon-containing solids from which essentially all of the volatilizable hydrocarbons have been removed, but which may still contain residual carbon.

The term "spent solids" is used in the present invention to mean retorted solids from which most and preferably essentially all of the combustible residual carbon has been removed.

The terms "condensed", "noncondensable", "normally gaseous", or "normally liquid" is relative to the condition of the material at 77° F (25° C) and 1 atmosphere.

The process of the present invention is best understood by reference to the accompanying drawing.

In the embodiment shown in the drawing, precrushed raw shale is introduced by conventional means via line 1 into a lower portion of a substantially vertical elongate vessel or lift pipe 5, while a solid heat-transfer material is introduced by conventional means at an elevated temperature via line 3. The size of the shale inroduced can vary greatly from 0.001 to ½ inch in diameter or more. Preferably, the shale feed is precrushed to be ¼ inch or less in diameter. Preferably, the raw shale feed comprises a mixture of shale fines and larger pieces of shale. One advantage of the present invention is that the process can accommodate a wide size range of raw shale as distinguished from prior art processes which are directed either to the processing of shale fines or to the processing of larger pieces of shale of ¼ inch in diameter or larger.

The solid heat-transfer material can also vary greatly in size and can be composed of numerous substances, for example, sand, steel or ceramic balls. Preferably, the heat-transfer material comprises coarse spent shale which has been heated to an elevated temperature by combustion of the residual carbon remaining after retorting.

The shale can be introduced over a wide range of temperatures, but preferably it is introduced at from 50° to 399° F and more preferably it is introduced at ambient temperature.

The heat-transfer material is introduced at an elevated temperature in the range of 1000° to 2000° F or higher, but preferably in the range 1200° to 1600° F. The quantity and temperature of the heat-transfer material introduced in the vessel can readily be adjusted to heat the raw shale to the desired retorting temperature. The weight ratio of the solid heat-transfer material to the fresh shale introduced will generally be in the range from 0.5 to 10 and preferably in the range 1.0 to 5.0.

A noncombustion-supporting lift gas is introduced by conventional means below the raw shale and the heat-transfer material via line 7 at a velocity sufficient to entrain and convey the shale and heat-transfer material upwardly through the lift pipe. Typically, the linear velocity of the lift gas will be in the range 20 to 120ft/sec. The lift gas contains essentially no free oxygen (less than 1 volume percent) so as to prevent or minimize combustion in the lift pipe and avoid the loss of product hydrocarbons through combustion. The gas may be introduced at an elevated temperature in the range 100° to 1000° F, but preferably it is introduced at ambient temperature. The lift gas is preferably inert to the shale and may comprise steam, $H_2$, CO, $CO_2$, light hydrocarbons, such as methane, ethane or propane.

Preferably, the lift gas comprises recycle light product gas from the retort comprising a mixture of $H_2$, CO, $CO_2$, methane and ethane.

In the lift pipe, the solids are rapidly mixed by the turbulent action of the gas and considerable heat transfer and retorting occurs. The shale is rapidly heated to an elevated temperature greater than 650° F and preferably in the range of 700° to 1300° F, and more preferably 800° to 1000° F. Residence time of the shale in the lift pipe is very short, 1 to 15 seconds, and preferably less than 5 seconds. The shale is rapidly heated and a minor amount of the volatile hydrocarbons in the shale are liberated from the solid in the lift pipe forming partially retorted shale. Less than 50 weight percent, and preferably less than 30% of the total volatile hydrocarbons present in the raw shale is vaporized in the lift pipe section of the retort. The degree of volatilization in the lift pipe will vary depending on many factors, such as, the residence time and the size distribution of shale feed. These and other parameters are, of course, readily adjusted by any person skilled in the art to control the degree of volatilization in the lift pipe.

The lift pipe discharges an effluent stream comprising the lift gas, entrained gaseous hydrocarbons, partially retorted solids, and the solid heat-transfer material into a suitable gas-solid disengaging zone, such as, a cyclone or settling vesssel 9 wherein the gas and solids are separated. The separated solid fraction comprising the partially retorted shale and heat-transfer material is conveyed or drops into an upper portion of a second vertically elongated vessel 11 to form a downwardly moving bed of partially retorted shale and heat-transfer material. In the retorting vessel or stripper vessel 11, heat transfer between the hot solid heat-transfer material and the partially retorted shale is completed and the remaining volatilizable hydrocarbons are vaporized. Retorted shale and heat-transfer material are removed by conventional means from the bottom of the stripper vessel via line 13. The residence time of solids in the stripper retorting vessel can vary widely but will typically be in the range of 1 to 20 minutes, and preferably 2 to 5 minutes. Preferably the residence time and other variables are adjusted so that 90 weight percent or more of the volatilizable hydrocarbons (as determined by Fischer-Assay) present in the raw shale are vaporized. Preferably, the quantity and temperature of the heat transfer material introduced in the lift pipe are adjusted to maintain the temperature in the stripper vessel high enough to achieve essentially complete vaporization of the volatilizable hydrocarbons.

A stripping gas is introduced into a lower section of vessel 11 via line 12 and flows upward countercurrent to the movement of the downward flowing solids. The stripping gas is maintained essentially free of molecular oxygen and is of the same composition as the lift gas, previously described. Preferably, the stripping gas comprises recycle light product gas. The stripping gas quickly entrains and transports the vaporized hydrocarbons out of the downward moving bed of shale. The stripping gas may be introduced at a temperature in the range from ambient (77° F) to 1100° F. If introduced at ambient temperature, the gas is rapidly heated by the downflowing hot solids. The stripping gas leaves the vessel at essentially the same temperature as the inflowing hot solids. The velocity of the stripping gas can vary greatly from about 0.5 to 5.0 ft/sec or higher. Low velocities in the range 0.5 to 1.0 are preferred in order to minimize the entrainment of dust in the effluent stream. Preferably, the stripping gas velocity is maintained substantially below the terminal velocity of a substantial portion (70 weight percent or more) of the downwardly moving solids.

Both the stripping gas and the lift gas contain entrained gaseous hydrocarbons and while still hot they are passed via line 14 to additional solids separation means, such as cyclones 15 and 17 and electrostatic precipitator 19 to remove residual dust prior to condensation and separation of the condensable hydrocarbons. The gas is then passed through condensation zone 21 and separation zone 22 wherein the light gaseous product is separated from the condensable liquid product. The product gas 23 will normally comprise $H_2$, CO, $CO_2$, methane and ethane and the condensable product 25 will comprise $C_5$ and higher boiling hydrocarbons. The $C_3$ and $C_4$ hydrocarbons can be separated by low temperature condensation, if desired, or recycled along with the light product gas.

The two vessels, the lift pipe retort and stripper retort, are both preferably maintained at or near atmospheric pressure.

The retorted solids 13 contain residual fixed carbon. Preferably, the retorted solids, along with the shale and dust from cyclones 15 and 17, are combined via lines 31, 32 and 33 and introduced into a lower portion of a combustion lift pipe 35 via line 34. Air or some other oxygen-containing gas is injected via line 37 into the combustor lift pipe. In combustor lift pipe 35, the residual carbon contained in the retorted shale is burned forming spent shale and heat-transfer material at an elevated temperature substantially above the retorting temperature, preferably in the range 1000° to 1600° F. The effluent 36 from the lift pipe combustor is passed through cyclones 37 and 39 or other conventional separation means wherein the solids are separated from the flue gas. A portion of the solids, preferably shale fines, is discarded via line 41 and ancther portion of the solids is recycled via line 3 to the lift pipe 5 as the solid heat-transfer material. Preferably, the solid heat-transfer material comprises the coarser portion of the spent shale, i.e., pieces about 1/16 inch in diameter or larger.

The process of the present invention offers many advantages over prior art processes, more specifically:

(1) Essentially all, 70% or more, of the volatilized hydrocarbons are liberated in the top one-third of the lift pipe and the top one-third of the stripper and the volatilized hydrocarbons are then rapidly removed from the vessel by the upflowing gaseous streams. This rapid removal of the hydrocarbons greatly reduces detrimental side reactions such as cracking and polymerization which tend to decrease the quantity and quality of the condensed liquid product.

(2) The shale is moved through the entire retorting system by a highly efficient and simple means.

(3) The process has a high thermal efficiency since the raw shale can enter the system cold, and preheating of the lift gas, and stripping gas, may not be required.

(4) The process provides for a high throughput of solids for relatively small sized retorting vessels, which results in substantial reduction in capital costs.

(5) The quality and quantity of condensable hydrocarbons is increased by avoiding condensation of the volatilized hydrocarbons in the retorting vessels.

What is claimed is:

1. A continuous process for retorting oil shale which comprises:

(a) introducing a solid heat-transfer material at an elevated temperature in the range 1000° to 2000° F and oil shale into a lower portion of a first vertically elongated vessel at a weight ratio of said heat-transfer material to said oil shale of greater than 0.1 and less than 5;

(b) passing a lift gas containing less than 1 volume percent free oxygen upwardly through said first vessel at a linear velocity of 20 to 200 feet per second and sufficient to entrain and convey said oil shale and said heat-transfer material upwardly through said vessel, whereby said oil shale and said heat-transfer material are intermixed and said oil shale is rapidly heated to an elevated temperature between 700° F and 1200° F, vaporizing a first portion comprising less than 30 weight percent of the hydrocarbons in said oil shale, said oil shale having a residence time in said first vessel of less than 5 seconds;

(c) separating from said lift gas a solid fraction comprising said heat-transfer material and oil shale;

(d) introducing said solid fraction into the upper portion of a second vertically elongated vessel forming a downwardly moving bed of solids wherein additional heat is transferred from said heat-transfer material to said oil shale, vaporizing a second portion of the hydrocarbons in said oil shale;

(e) withdrawing retorted solids and said heat-transfer material from a lower portion of said second vessel;

(f) passing a stripping gas upwardly through said second vessel which entrains said vaporous second portion of hydrocarbons;

(g) separating condensable hydrocarbons from said lift gas and said stripping gas; and (h) introducing retorted solids into a lift pipe combustor and combusting residual carbon in said retorted shale, forming spent shale at an elevated temperature in the range from 1000° F to 1600° F, and introducing said spent shale into said first vessel to provide said heat-exchange material.

2. The process of claim 1 wherein said lift gas and said stripping gas are essentially free of molecular oxygen and comprise recycled light product gas.

* * * * *